US011569554B2

(12) United States Patent
Menargues Gomez et al.

(10) Patent No.: US 11,569,554 B2
(45) Date of Patent: Jan. 31, 2023

(54) ORTHOMODE TRANSDUCER

(71) Applicant: SWISSto12 SA, Renens (CH)

(72) Inventors: Esteban Menargues Gomez, Lausanne (CH); Santiago Capdevila Cascante, Renens (CH); Tomislav Debogovic, Chexbres (CH)

(73) Assignee: SWISSTO12 SA, Renens VD (CH)

( * ) Notice: Subject to any disclaimer, the term of this patent is extended or adjusted under 35 U.S.C. 154(b) by 275 days.

(21) Appl. No.: 16/761,528

(22) PCT Filed: Nov. 6, 2018

(86) PCT No.: PCT/IB2018/058697

§ 371 (c)(1),
(2) Date: May 5, 2020

(87) PCT Pub. No.: WO2019/087166

PCT Pub. Date: May 9, 2019

(65) Prior Publication Data

US 2020/0266510 A1 Aug. 20, 2020

(30) Foreign Application Priority Data

Nov. 6, 2017 (EP) ..... 17200223

(51) Int. Cl.
*H01P 1/161* (2006.01)
*H01P 1/163* (2006.01)
(Continued)

(52) U.S. Cl.
CPC ..... *H01P 1/161* (2013.01); *H01P 1/163* (2013.01); *H01P 5/16* (2013.01); *H01Q 13/02* (2013.01)

(58) Field of Classification Search
CPC . H01P 1/161; H01P 1/163; H01P 5/16; H01Q 13/02
See application file for complete search history.

(56) References Cited

U.S. PATENT DOCUMENTS 4,228,410 A 10/1980 Goudey et al.
8,477,075 B2 7/2013 Seifried et al.

FOREIGN PATENT DOCUMENTS

EP 0805511 A2 11/1997
EP 2287969 A1 2/2011
(Continued)

OTHER PUBLICATIONS

Menargues et al "Compact Orthomode Transducer with Broadband Beamforming Capability" Jun. 2018 IEEE/MTT-S International Microwave Symposium pp. 152-155. (Year: 2018).*
(Continued)

*Primary Examiner* — Lincoln D Donovan
*Assistant Examiner* — Kimberly E Glenn
(74) *Attorney, Agent, or Firm* — Pearne & Gordon LLP

(57) ABSTRACT

An orthomode transducer including a first Boifot junction and a second Boifot junction. Each of the first and second Boifot junctions includes a dual polarized port, a first lateral port, a second lateral port, the first and second lateral port being single polarized, and a third single polarized port along the propagation direction of a signal in the dual polarized port. A first power divider for coupling the first lateral port of the first Boifot junction with the first lateral port of the second Boifot junction to a third port. A second power divider for coupling the second lateral port of the first Boifot junction with the second lateral port of the second Boifot junction to a third port. A third power divider for coupling the third port of the first power divider with the third port of the second power divider to a fourth single polarization port.

15 Claims, 12 Drawing Sheets

(51) Int. Cl.
*H01P 5/16* (2006.01)
*H01Q 13/02* (2006.01)

(56) References Cited

FOREIGN PATENT DOCUMENTS

| | | | |
|---|---|---|---|
| EP | 2869400 | A1 | 5/2015 |
| WO | 2012/172565 | A1 | 12/2012 |

OTHER PUBLICATIONS

Fonseca, Nelson J.G., "Compact Waveguide Orthomode Transducer Without Crossings", 2009 13th International Symposium on Antenna Technology and Applied Electromagnetics and the Canadian Radio Sciences Meeting, Feb. 15-18, 2009, Banff, AB, Canada.
International Search Report for PCT/IB2018/058697 dated Jan. 23, 2019.
Written Opinion for PCT/IB2018/058697 dated Jan. 23, 2019.
Ruiz-Cruz, J A et al., "Full-wave modeling and optimization of Boifot junction ortho-mode transducers", International Journal of RF and Microwave Computer-Aided Engineering John Wiley & Songs Inc. USA, Jul. 4, 2008, pp. 303-313, vol. 18, No. 4, XP002780280.
Leal-Sevillano, Carlos A et al., "Development of a Wideband Compact Orthomode Transducer for the 180-270 GHz", IEEE Transactions on Terahertz Science and Technology, IEEE, Sep. 1, 2014, pp. 634-636, vol. 4, No. 5, Piscataway, NJ, USA, XP011557233.
Schulz, Christian et al., "A broadband circular TE11- to TE01-mode converter using stepped waveguide technique", 2014 44th European Microwave Conference, European Microwave Association, Oct. 6, 2014, pp. 311-314, XP032706494.
Fonseca, Nelson J.G., et al., "Compact Orthomode Power Divider for High-Efficiency Dual-Polarisation Rectangular Horn Antennas", 6th European Conference on Antennas and Propagation (EUCAP), IEEE, 2011, pp. 1024-1027.

* cited by examiner

ORTHOMODE TRANSDUCER

FIELD OF THE INVENTION

The present invention concerns an orthomode transducer, in particular an orthomode transducer with beamforming capabilities, and an antenna array including such a transducer.

DESCRIPTION OF RELATED ART

Arrays of polarized radiating elements (such as a horn antennas or waveguide apertures) are already known as a low-weight and low volume alternative to parabolic antennas. They are widely used in satellites telecommunications, radars, remote sensing or other telecommunication applications. The signal is often propagated to each element of the antenna array through waveguides or coaxial cables, or microstrip lines, or PCBs.

As an example, in satellite telecommunication applications, signals can be separated or isolated from each other through the use of different signal polarizations or frequencies. As an example, two orthogonal linear polarizations of the electromagnetic waveguides can be used to provide an isolation between those signals, for instance in the Ku and/or Ka band radio frequency bands. Therefore, orthomode transducers (OMT) are one of the most important components in such systems since they enable the spatial separation of signals with orthogonal polarizations. OMTs are especially interesting in examples such as waveguide-based dual-polarized antenna arrays.

Conventional orthomode transducers may comprise a Boifot junction as polarization filtering or separating element. Boifot junctions are described, among others, in THE INSTITUTION OF ELECTRICAL ENGINEERS, STEVENAGE, G B; July 2008 (2008 July), RUIZ-CRUZ J A ET AL: "Full-wave modeling and optimization of Boifot junction ortho-mode transducers", International Journal of RF and Microwave Computer-Aided Engineering John Wiley & Sons Inc. USA, vol. 18, no. 4, pages 303-313, ISSN: 096-4290.

An example of a conventional Boifot junction is shown on the exploded view of FIG. 1.

The illustrated Boifot junction is a four-port element, where the port 1 propagates two orthogonal polarizations (TE10-Vpol,TE01-Hpol). A metallic septum slowly splits the TE01 mode into two halves towards the ports 3 and 4 (lateral ports), while the TE10 mode propagates unaffected towards the port 2 (through port). The three ports 2,3,4 propagate only one polarization.

If the Boifot junction is used in the transmission channel between an antenna and an emitter/receiver, the dual polarized port 1 is usually the input port on the antenna side, while the three single polarized ports 2,3,4 are output ports on the emitter/receiver side.

Among the three single polarized ports, one of them 2 is placed along the propagation direction, with its broader side horizontally aligned on the figure, and in opposition to the dual polarized port 1. The other two single polarized ports 3,4 have their broader sides vertically aligned and are placed perpendicular to the propagation direction. These latter ports 3,4 are called lateral ports.

The internal obstacle or septum 5 acts as polarization filter. When two orthogonal polarizations propagate through the input port 1, the septum blocks the polarization with electrical field horizontally aligned (TE01) from passing through the junction. The mode is subdivided into two identical halves which are redirected towards the lateral ports 3,4. On the other hand, the polarization with electrical field vertically aligned (TE10) propagates unaffected towards the axial port 2. The TE01 cannot couple to the lateral ports, which are under cutoff for this mode.

The dual polarized port 1 is usually formed as a square or circular waveguide that propagate purely degenerate modes, but other symmetric geometries such as octagonal waveguides and not symmetric geometries that propagate two modes in one specific frequency band are also possible alternatives. For the single polarized ports 2, 3 and 4, rectangular waveguides are commonly used but other geometries may be considered.

This Boifot junction has two symmetry planes, allowing for wide bandwidth of the junction and of other components such as orthomode transducers using this junction as a polarization filter.

For the example of rectangular waveguides, the bandwidth of the component is determined by the waveguide width, which determines the excitation of the fundamental mode and the first higher-order at any port. In structures such as the ones shown in FIG. 1, with two symmetry planes and where the side of the input port and the broader side of the rectangular ports are equal, the fundamental mode is always the TE10 (and the degenerate mode TE01 at the input port), whose cutoff frequency is c/2a. Due to symmetries (and considering that the shorter side of the rectangular ports is $b \leq a/2$), the first high-order mode to be excited is the TE12 (and also its degenerate mode TM12), whose cutoff frequency is 1.118c/a This theoretically guarantees a bandwidth of more than one octave (fmax=2.236 fmin).

Boifot junctions such as the one of FIG. 1 can have different input and output ports of different broader dimensions. In such cases the bandwidth of the component is determined by the highest fundamental mode and the lowest higher-order mode of input and output waveguides.

The dual-polarized port of the Boifot junction is often done using a circular waveguide. Circular waveguides offer slightly smaller bandwidth than square/rectangular waveguides. In any case, by properly selecting the waveguide dimensions is still possible to reach a bandwidth of one octave.

One-fold symmetry junctions have narrower operational bandwidths due to the presence of additional high-order modes with lower cutoff frequencies than c/a.

Other two-fold symmetry junctions such as five port turnstile junctions also offer bandwidths of more than octave. Examples of turnstile junctions are described in WO2012172565 and in EP0805511.

Boifot OMTs are often preferred over Turnstile OMTs for communication systems due to their more reduced size and compactness.

The two-fold symmetry of Boifot junction also ensures that the leakages between polarizations are minimal.

Both the lateral ports 3,4 and the axial port 2 may present additional elements (not shown in the figure) to enhance the impedance matching of the junction such as iris, pins, waveguide steps, variations in waveguide aperture etc.

FIG. 2 is an exploded view of another Boifot junction using a ridged section or wedge as polarization filter. The port 1 is a square waveguide supporting two degenerate modes (TE10-Vpol, TE01-Hpol). The metallic wedge slowly splits the TE01 mode into two halves towards the ports 3 and 4 (lateral ports, or side ports), while the TE10 mode gets choked towards the port 2 (through port).

FIG. 3 is an exploded view of another Boifot junction where the polarization filter is created by means of two hybrid couplers placed at the sides of the junction. These couplers completely extract the TE01 mode from the input waveguide 1. The waveguide metallic terminations are in charge of redirecting the extracted signal towards the lateral ports 3,4. As in previous examples, the TE10 mode propagates unaffected towards the axial port 2.

In order to design a complete orthomode transducer using any of the Boifot junctions presented before, the lateral ports 3,4 need to be first bended backwards and then recombined into a single waveguide 6 using a recombinating network 12, as illustrated on FIG. 3.

The other polarization route 2 often contains guiding elements such as bends or transformers 7.

OMTs are commonly mounted behind the radiating elements in order to join two orthogonal waveguides 6, 7 into a single dual-polarized waveguide 1 that transmits the signal from the radiating elements to a receiver.

In such an array, two Boifot OMTs need to face each other, as illustrated on FIG. 4. If the space constraints are severe, two independent Boifot OMTs cannot be connected: either they would intersect or they would require more than one wavelength of separation between the common ports of adjacent OMTs. When designing an array, neither Boifot OMTs nor Turnstile OMTs are generally used due to their size. Commonly used dual-polarized waveguide-based arrays radiate through slots, thus not enabling broadband performance (>40%).

Therefore, in the prior art, the coexistence of the two orthogonal waveguides 6, 7, of the Boifot junction, the size of the recombination network 12, and the need to mount two Boifot junctions facing each other, imply that the OMT footprints is larger than one wavelength, thus defining the separation between consecutive radiating elements of the array. Therefore, arrays of radiating elements backed with OMTs tend to be relatively large and bulky.

When designing an array, separation between radiating elements larger than one wavelength creates secondary beams with relatively high directivity (the so-called grating lobes) in the array's front hemisphere. These beams, whatever the application is, are generally undesired because they pollute other systems' performance.

One array of OMTs has been described in EP2869400A1. This document describes a new kind of linear polarized OMT and power dividers to connect them. This design can be considered as based on a Turnstile OMT with two of the arms which are short-circuited. The short-circuited arms act as matching stub/reactive loads. This component is asymmetric, thus limiting the bandwidth. The array described in EP2869400A1 is also designed to have separation between antennas in all directions larger than one wavelength at the highest frequency of operation.

Another array of OMTs has been described in U.S. Pat. No. 8,477,075B2. This document describes an array of rectangular gridded horns backed by septum OMTs with several waveguide steps to widen the bandwidth. Such OMTs only have one symmetry plane, thus not enabling theoretical bandwidths of up to one octave.

Another arrays of OMTs have been described in EP2287969A1 and "Compact Orthomode Power Divider for High-Efficiency Dual-Polarisation Rectangular Horn Antennas" (N. J. G. Fonseca and P. Rinous, 6th European Conference on Antennas and Propagation). Such arrays are narrowband and were designed to have separation between antennas in all directions larger than one wavelength at the highest frequency of operation.

In order to avoid those drawbacks, a first aim of the present application is to propose a new broadband orthomode transducer with beamforming capabilities in which the minimal distance between radiating elements can be reduced.

The component should allow for separations smaller than one wavelength in the horizontal axis and smaller than two wavelengths in the vertical axis at the highest frequency of operation.

Another aim of the present invention is to design a compact OMT that could be adapted for an antenna array, and a complete antenna array.

In order to create the antenna array a series of power dividers (also called power splitters and, when used in reverse, power combiners), bends and waveguide twists are used.

This arrangement is advantageous if the distance between adjacent Boifot junctions is smaller than one wavelength. It can also be used if this distance is larger or equal than one wavelength.

This OMT and the antenna array may be adapted for Ku-band satellite communications such as broadband performance from 10.7 GHz to 14.5 GHz, compliance with FCC gain mask as much as possible or Ka-band satellite communications such as broadband performance from 17 GHz to 22 GHz, and from 27 GHz to 32 GHz, with compliance with FCC gain mask as much as possible.

The antenna array preferably comprises rectangular horn antennas, for example antennas of 20 mm×40 mm (around $1\lambda \times 2\lambda$ at 14.5 GHz).

This antenna could be arranged in an array free of grating lobes for the most relevant angles (<80° in one axis).

The proposed component should be broadband and be either linearly or circularly polarized.

This transducer could be used to feed antennas.

This transducer could be used in a SOTM application.

The orthomode transducer is preferably adapted for one among:

C-band satellite communication;

X-band satellite communication;

Ku-band satellite communication;

Ka-band satellite communication;

Q-band satellite communication; and/or V-band satellite communication.

BRIEF SUMMARY OF THE INVENTION

According to the invention, these aims are achieved by means of an orthomode transducer with beamforming capabilities comprising a first Boifot junction such as the ones of FIG. 1-2; a second Boifot junction such as the ones of FIG. 1-2, preferably equal to the first one for symmetry reasons; each of said first and second Boifot junction comprising a dual polarized port, a first lateral port, a second lateral port, the first and second lateral port being single polarized, and a third single polarized port along the propagation direction of a signal in the dual polarized port. A first power divider couples the first lateral port of the first Boifot junction with the first lateral port of the second Boifot junction to a third port. A second power divider couples the second lateral port of the first Boifot junction with the second lateral port of the second Boifot junction to a third port. A third power divider couples the third port of the first power divider with the third port of the second power divider to a fourth single polarization port.

Therefore, in one aspect, the adopted solution consists in not using an OMT's recombination network, and instead of that, connecting two adjacent Boifot junctions in "incomplete" OMTs through power dividers.

The adopted solution thus involves a step of modifying the Boifot junction in order to provide inter-junction connections of the corresponding lateral ports. Both lateral ports of each Boifot junction are only recombined after their connection with the corresponding lateral ports of the adjacent Boifot junction.

Instead of connecting the two lateral ports 2,3 of a Boifot junction immediately in an OMT, a first lateral port of a first junction is coupled to the equivalent port of an adjacent junction, while the second lateral port of the first junction is coupled to the second port of the adjacent junction. The coupled first and second ports are then recombined using a third power divider.

The separation between two adjacent Boifot junction horns is preferably smaller than the nominal wavelength and the separation between two Boifot junctions in one second direction orthogonal to the first direction is preferably smaller than two nominal wavelengths. However, the proposed design could also be used when the separation in the first and second direction is equal or larger than one nominal wavelength.

Power dividers (also called power splitters and, when used in reverse, power combiners) are passive waveguide based devices used to split the electromagnetic power in a transmission line between two ports; in the reverse direction, they are used to combine the electromagnetic from two ports into one single signal.

The power dividers used to combine the lateral ports are preferably stepped because of their broader bandwidth and compactness, but may also have other geometries, including smooth walled designs. Moreover, the power dividers can be either of symmetric power distribution (−3 dB) or of asymmetric power distribution, depending on the further required beam.

This arrangement with two Boifot junctions can be used as such.

In one embodiment, a plurality of such arrangements are combined. Preferably, a fourth power divider couples the third single polarized port of the first Boifot junction with the third single polarized port of the second Boifot junction to a fifth single polarized port (orthogonal output).

The fourth power divider is preferably placed between the first and the second power divider.

The fifth port (orthogonal output) is preferably bended.

The fourth port is preferably arranged for transmitting a first linear polarization while said fifth port is preferably arranged for transmitting a second linear polarization orthogonal to the first polarization.

The orthomode transducer is preferably adapted for Ku-band satellite communication such as broadband performance from 10.7 GHz to 14.5 GHz), with compliance with FCC gain mask as much as possible.

The orthomode transducer is preferably adapted for Ka-band satellite communication such as broadband performance from 17 GHz to 22 GHz, and from 27 GHz to 32 GHz, with compliance with FCC gain mask as much as possible.

The orthomode transducer with beamforming capabilities is preferably produced monolithically, or out of reduced number of parts, in order to reduce cost and attenuation at the junction between parts. However, some of the benefits of the claimed solution can also be achieved with an orthomode transducer composing an assembly of different parts.

In a preferred embodiment, the orthomode transducer with beamforming capabilities comprises a 3D printed core potentially also including conductive plated sides or surfaces.

The invention is also related to an antenna array comprising at least one orthomode transducer with beamforming capabilities according to any of the preceding claims, and two horn antennas, being each one connected to each dual polarized port of the orthomode transducer with beamforming capabilities.

The horn antennas are preferably rectangular horn antennas but may also have other shapes.

In the case of an array designed for transmission in the Ku-band, the dimensions of the horn antennas are preferably 20 mm×40 mm (around 1λ×2λ at 14.5 GHz).

This antenna could be arranged in an array free of grating lobes for the most relevant angles (<80°).

The separation between two antennas horns in one first direction is preferably smaller than the nominal wavelength and the separation between two antennas horns in one second direction orthogonal to the first direction is smaller than two nominal wavelengths.

The nominal wavelength is the wavelength for or minimal wavelength for which the array is designed.

The antenna array should allow for separations between adjacent antennas smaller than one wavelength in the horizontal axis and smaller than two wavelengths in the vertical axis.

The antenna array is preferably broadband, i.e., its bandwidth can cover up to one octave.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

Figure 1:
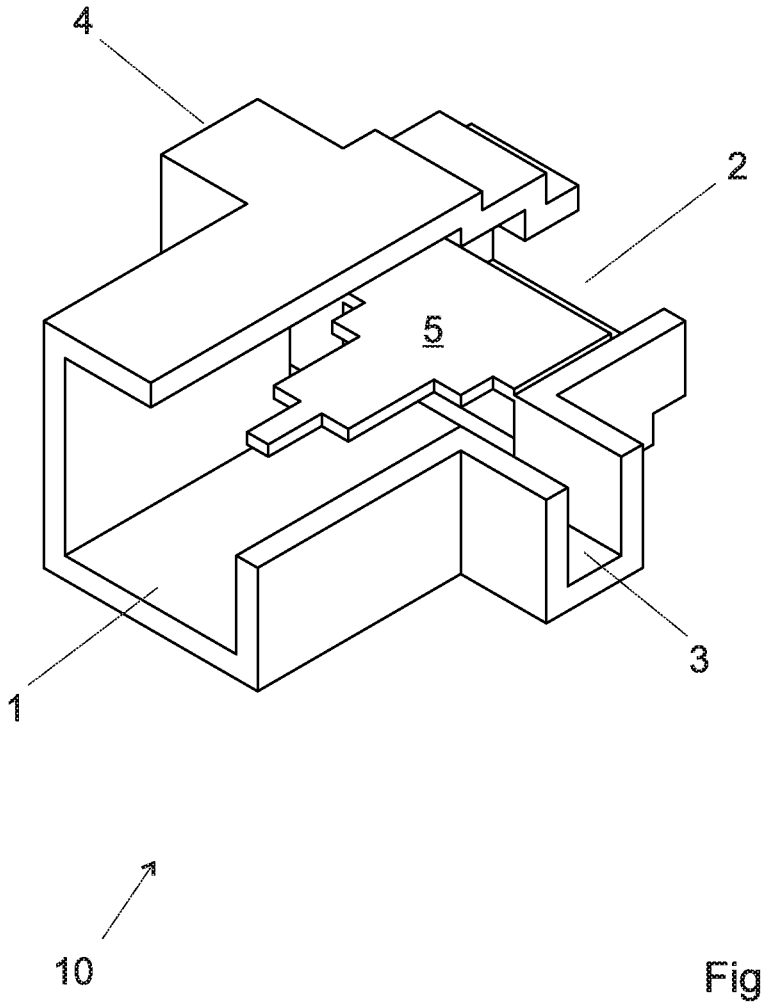
FIG. 1 shows an exploded view of a Boifot junction, one part of the side walls being removed in the illustration in order to show the septum.
Figure 2:
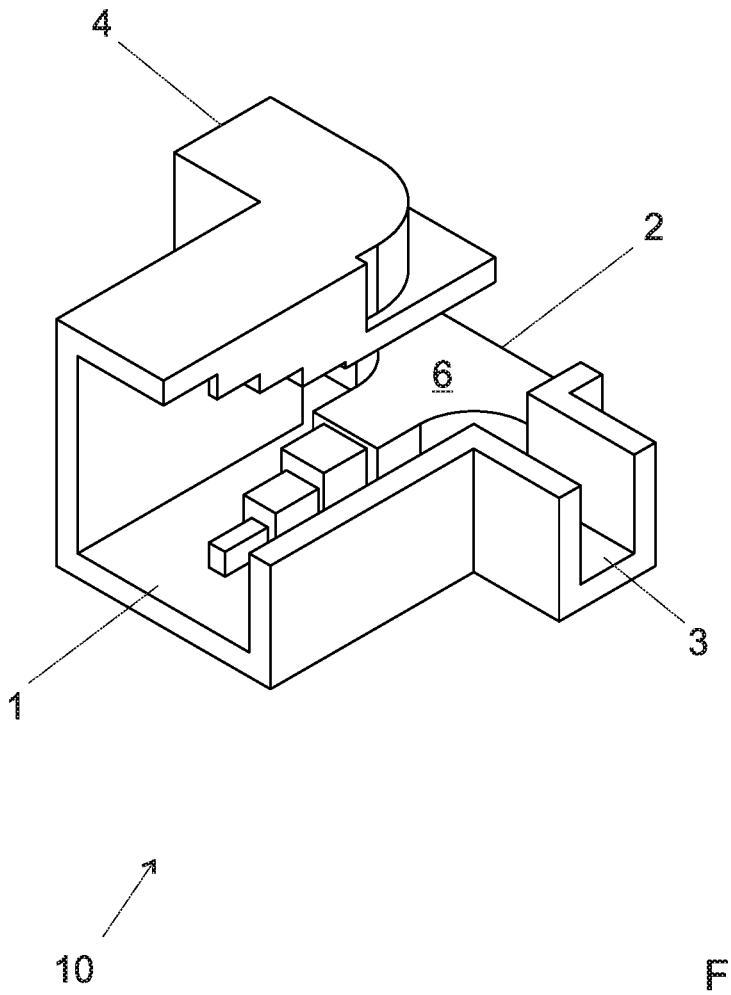
FIG. 2 shows an exploded view of a Boifot junction with a ridged edge, one part of the side walls being removed in the illustration in order to show the septum.
Figure 3:
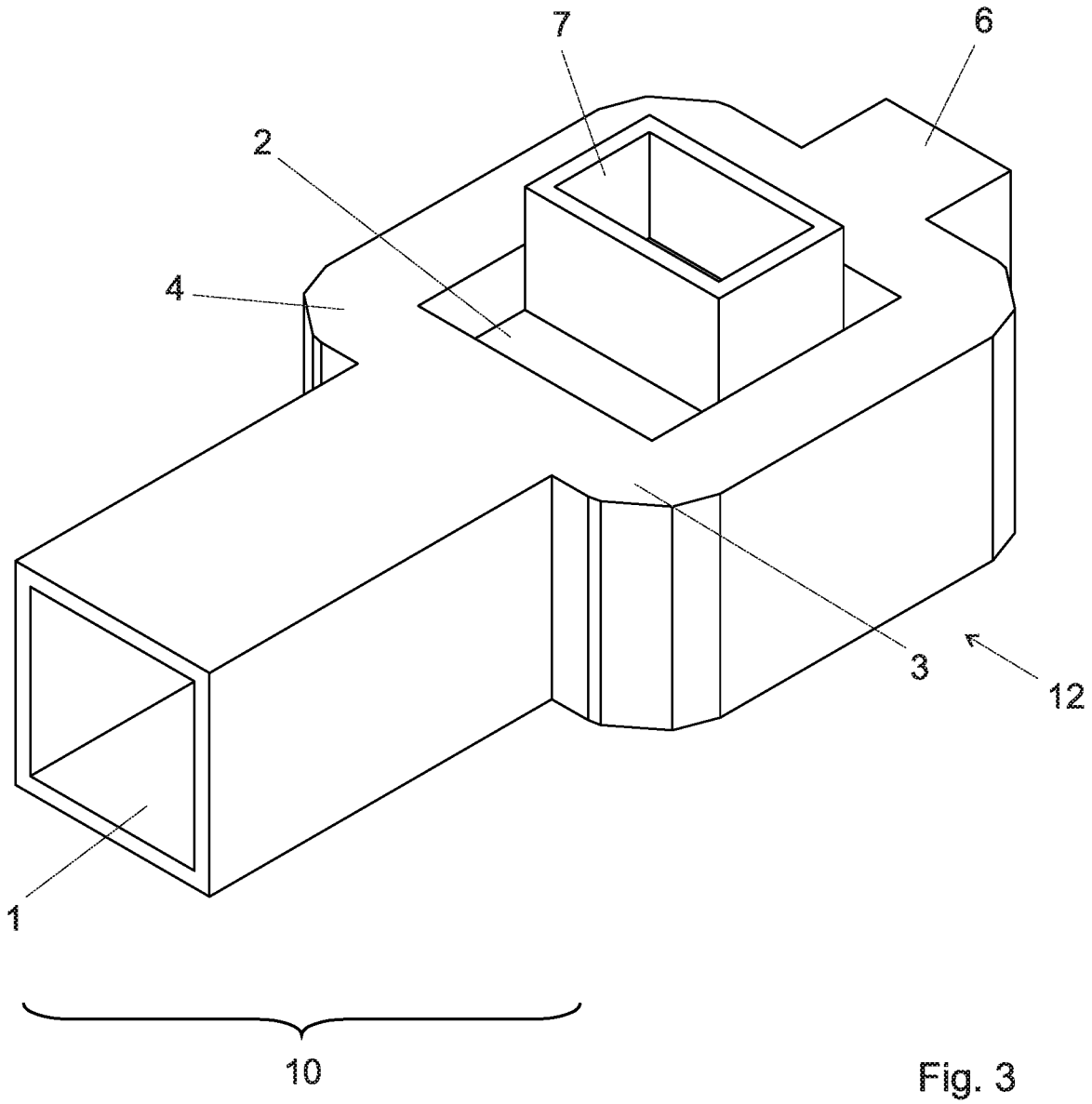
FIG. 3 shows an OMT transducer according to the prior art.
Figure 4:
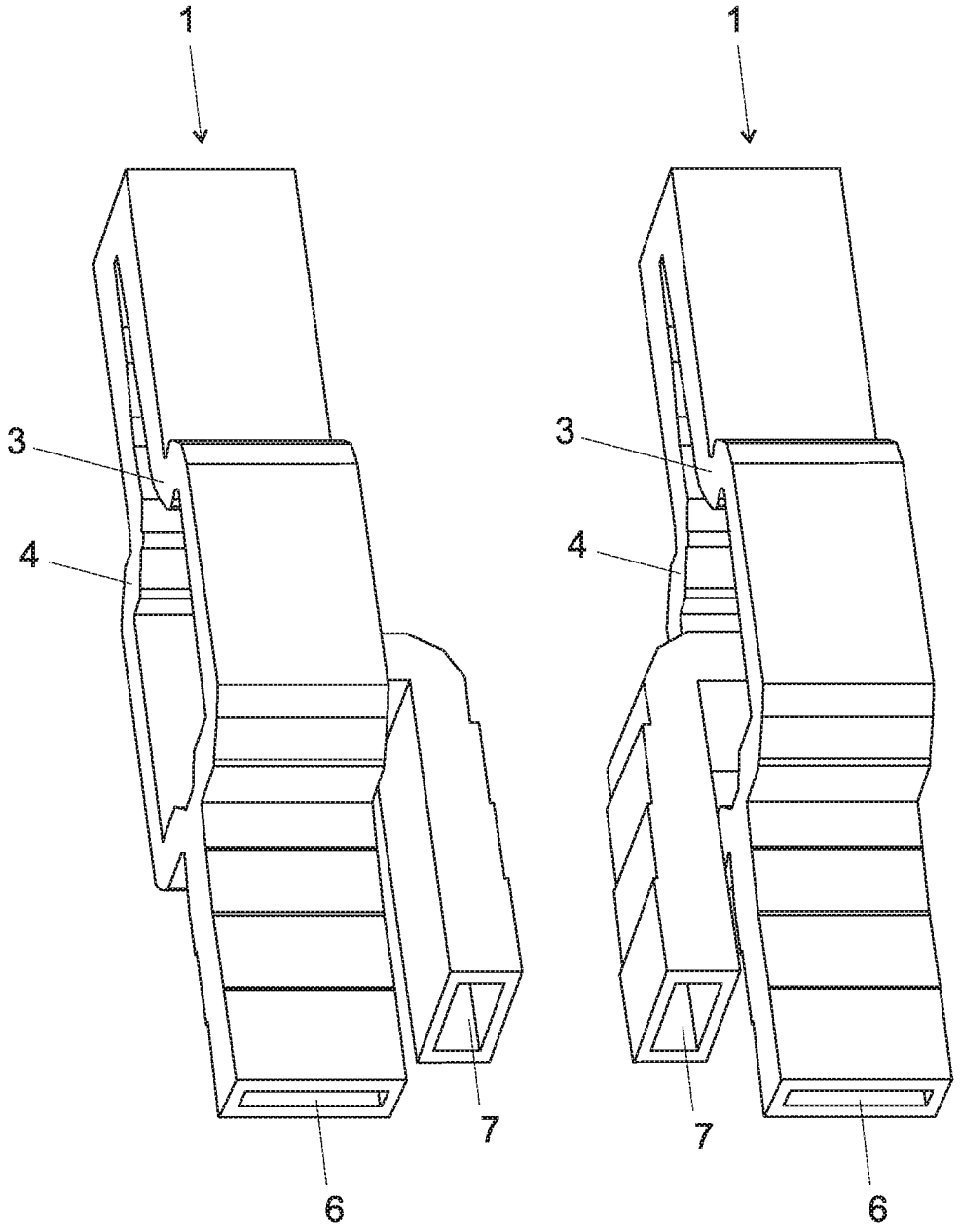
FIG. 4 shows a stack of two OMT transducers according to the prior art.
Figure 5:
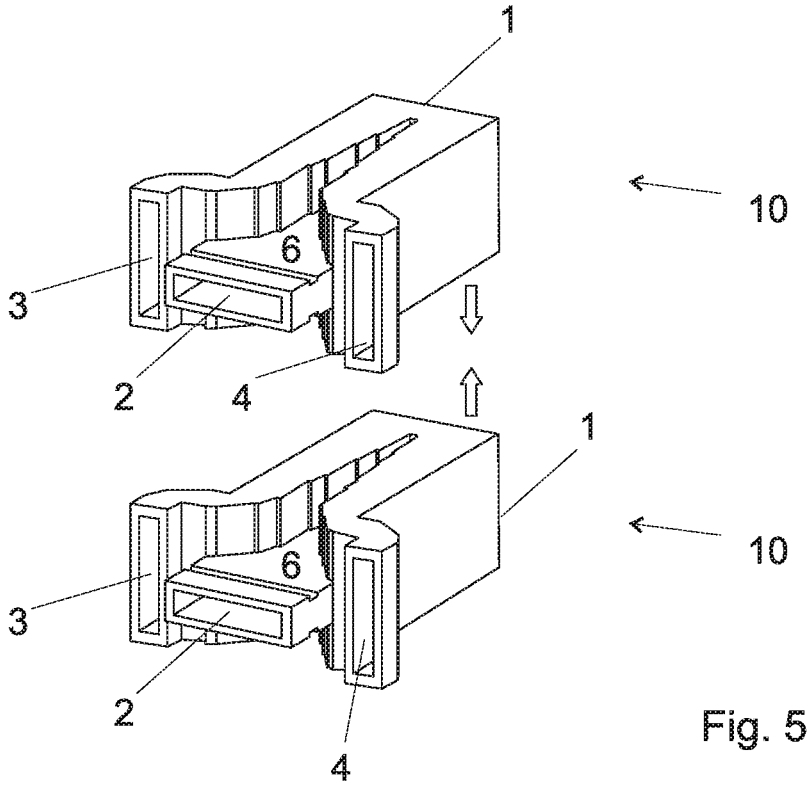
FIG. 5 shows a stack of two Boifot junctions used in the device of the invention.

FIG. 5 shows a stack of two Boifot junctions 10 that could be used in an orthomode transducer of the invention. Those Boifot junctions could be conventional and correspond to the above described junctions of FIG. 1 or 2 for example.

Each Boifot junction (FIGS. 1 and 2) 10 presents two symmetry planes: one horizontal symmetry plane (horizontal on the Figure, and parallel to the septum 5 or ridged wedge 6), and one vertical symmetry plane (vertical on the figure, and perpendicular to the septum).

Any of the illustrated Boifot junction 10 has four ports. The port 1 propagates two orthogonal polarizations (TE10-Vpol, TE01-Hpol). We will call this port the input port, although the junction is reversible and could be used in both directions, either in a receiver or in a receiver. The port 1 could have a waveguide with a rectangular section, or any other section that propagate purely degenerate modes. Symmetric geometries that propagate two modes in the desired frequency band are preferred because they are broadband.

A septum 5 acts as polarization filter and splits the TE01 mode into two halves towards the output ports 3 and 4 (lateral ports), while the TE10 mode gets choked towards the output port 2 (through port). The three ports 2,3,4 propagate only one polarization. The output through port 2 is placed along the propagation direction, with its broader side horizontally aligned on the figure, and in opposition to the dual polarized port 1. The two lateral ports 3,4 have their broader sides vertically aligned and are placed perpendicular to the propagation direction.

The septum 5 is preferably ridged. Ridged septums are known as such, but usually only used for very high frequencies, well above the KU/Ka frequency bands. As will be described, they are preferably made (as the rest of the component) by 3D printing, such as stereolithography, or selective laser sintering or selective laser melting which makes them easier to manufacture.

The septum is optional and orthomode transducers comprising other type of polarization filters could be considered.

The section of the output ports 2, 3 and 4 is preferably rectangular; other sections, preferably with two symmetry planes, are preferably used.

Figure 6:
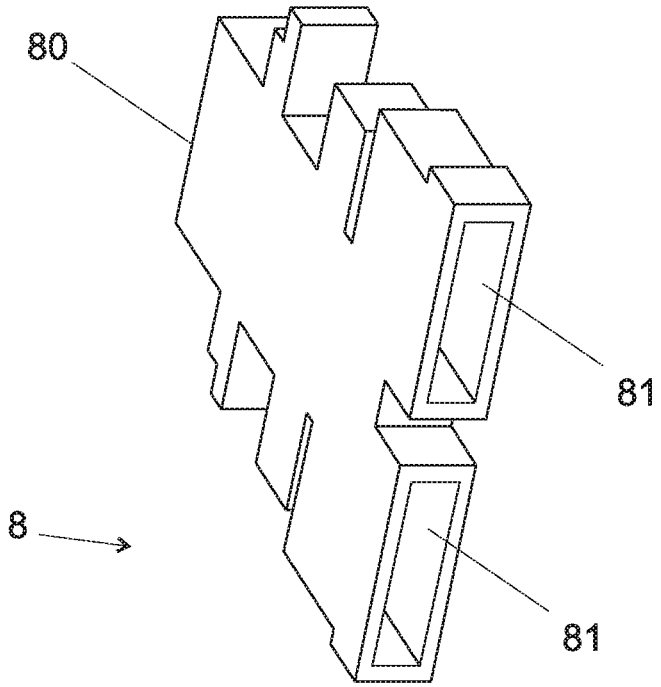
FIG. 6 shows a power divider that can be used to couple the first port of a first Boifot junction of FIGS. 1 and 2 with the first port of the second Boifot junction of these Figures (or to couple the second port of the first Boifot junction with the second port of the second Boifot).

FIG. 6 shows a power divider 8 used to couple the first lateral port 3 of the first Boifot junction of the FIG. 5 with the first lateral port 3 of the second Boifot junction of FIG. 5. A second, identical power divider 8 is used to couple the second lateral port 4 of the first Boifot junction of FIG. 5 with the second lateral port 4 of the second Boifot junction. The power divider 8 are preferably stepped because of their broader bandwidth and compactness. This power divider can be either of symmetric power distribution or of asymmetric power distribution, depending on the further required beam. Each power divider 8 has two inputs 81 for receiving the signal from the lateral outputs 3 or 4 of the Boifot junction, and one output 80 that combines the two input signals. Again, this component is reversible and the designation of "power divider" instead of "power coupler", and "input" instead" of "output" is only used in order to distinguish those elements in this text, without any implications as to the sense of transmission of the signal.

Figure 7:
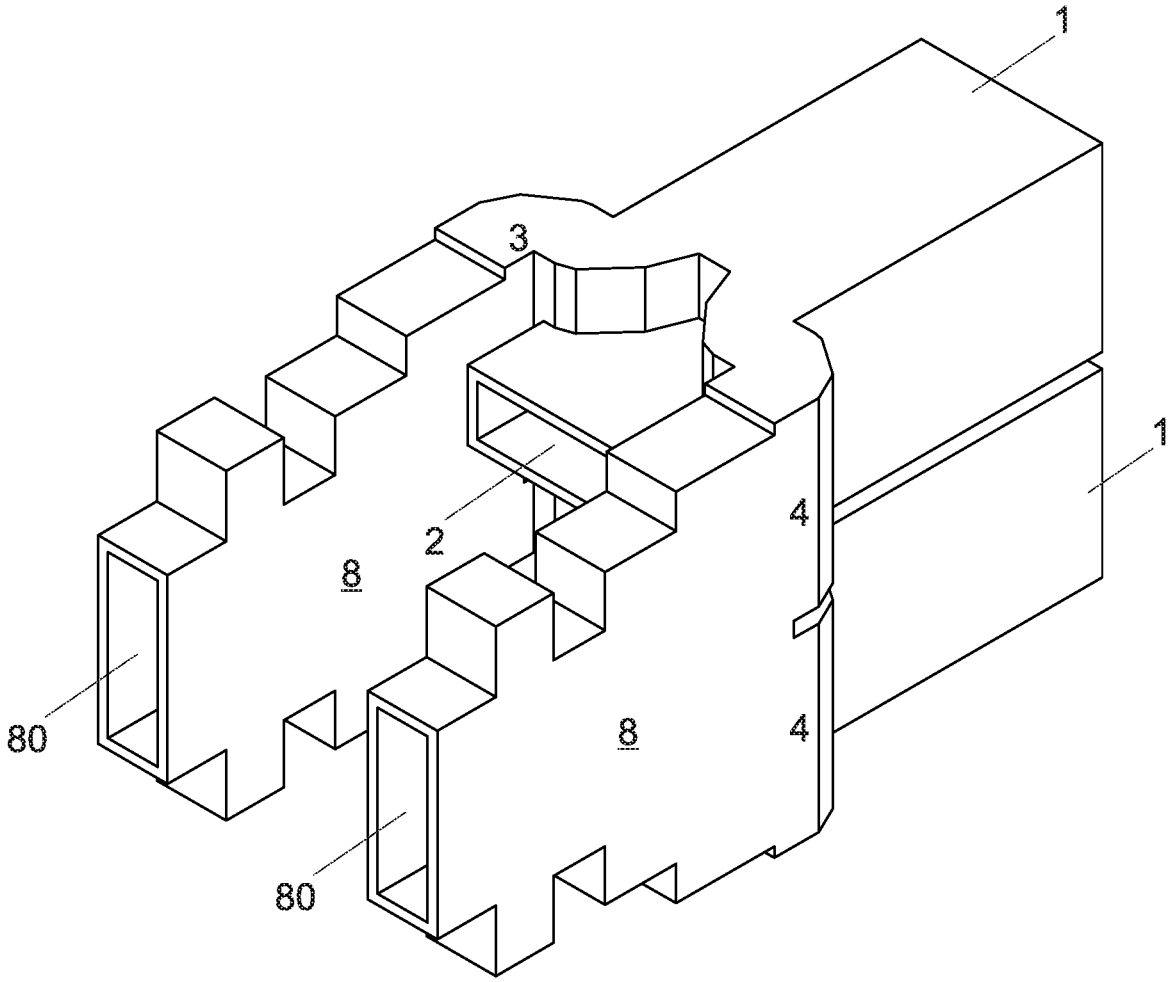
FIG. 7 shows a stack of two Boifot junctions according to FIGS. 1 and 2 coupled through two power dividers according to FIG. 6.

FIG. 7 shows an assembly comprising the two stacked Boifot junctions of FIG. 5 with their lateral ports 3 respectively 4 connected through the power dividers 8. As can be seen, the two lateral ports 3 of the upper and lower Boifot junctions are connected through one first power divider while the two other lateral ports 4 of the upper and lower Boifot junctions are connected through another power divider.

Figure 8:
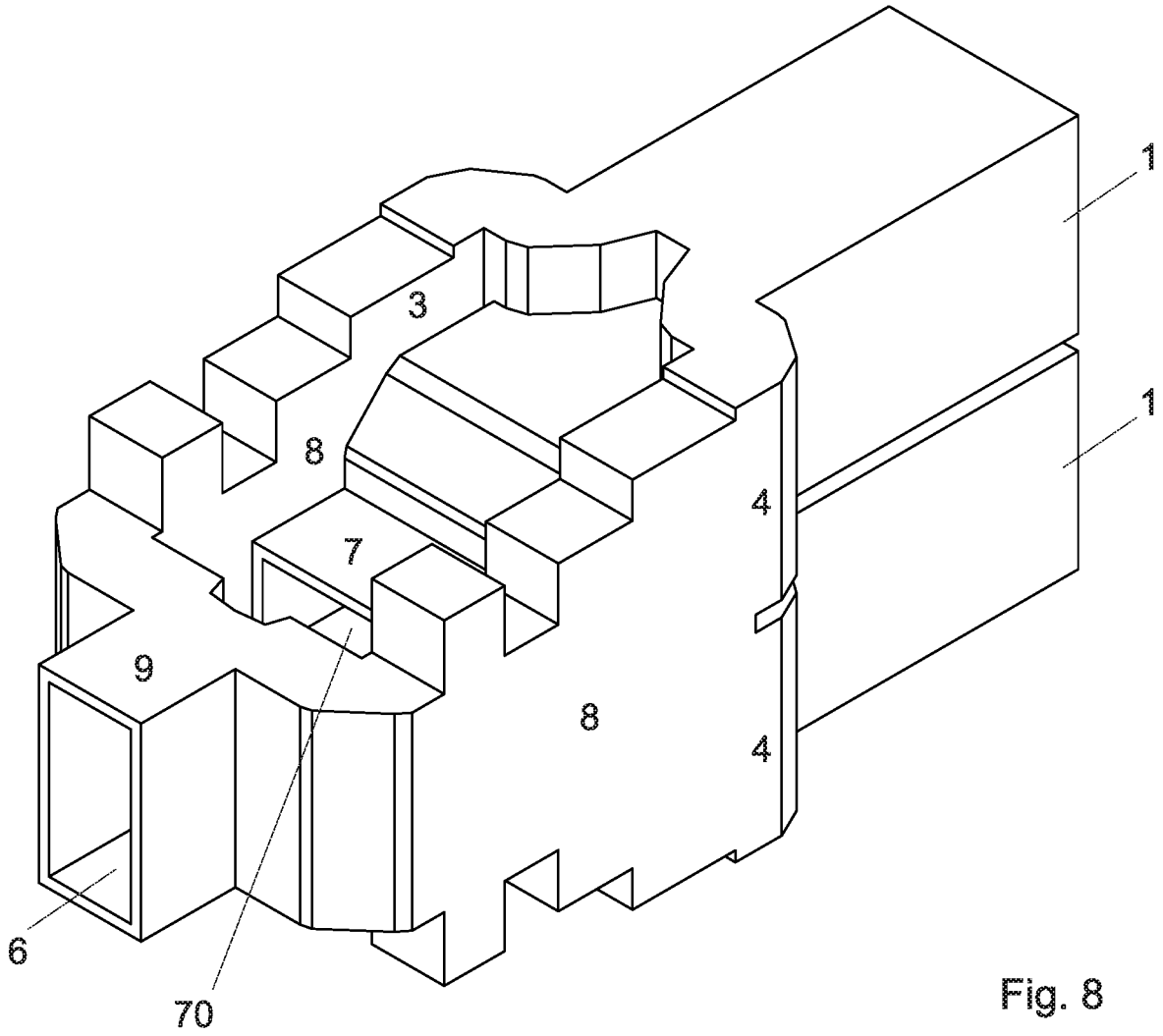
FIG. 8 shows a stack of two Boifot junctions according to FIGS. 1 and 2 coupled through two power dividers according to FIG. 6, the output port of those power dividers being coupled through another power divider.

FIG. 8 shows a complete orthomode transducer with beamforming capabilities based on the assembly of FIG. 7. It has two symmetry planes, one horizontal and one vertical. The symmetry planes concern only the empty path for the wave signal inside the component; the external sides do not need to be symmetrical.

In the component of FIG. 8, the two outputs 80 of the power dividers 8 are coupled through another power divider 9 with one output 6. The coupling between the lateral ports 3 and 4 happens only in this power divider 9, after a combination with the equivalent ports of another Boifot junction. Moreover, the through outputs 2 of both Boifot junctions are coupled with a fourth power divider 7 between the two power dividers 8. This power divider couples the vertical polarized signals at the two through outputs of the two Boifot junctions.

The component of FIG. 8 is preferably monolithic (monobloc), i.e., made of one single part. In one preferred embodiment, this part is made by 3d printing a core, for example using a stereo lithography process or selective laser sintering process or selective laser melting process. The core is preferably non-conductive and could be made of a plastic, such as polyamide or a conductive metal such as aluminium. This core can then be plated with a conductive layer, such as Copper or Silver. This 3D printing process of one monolithic part reduces the perturbations caused by junctions between parts, and reduces the bulk and weight of the component.

Figure 9:
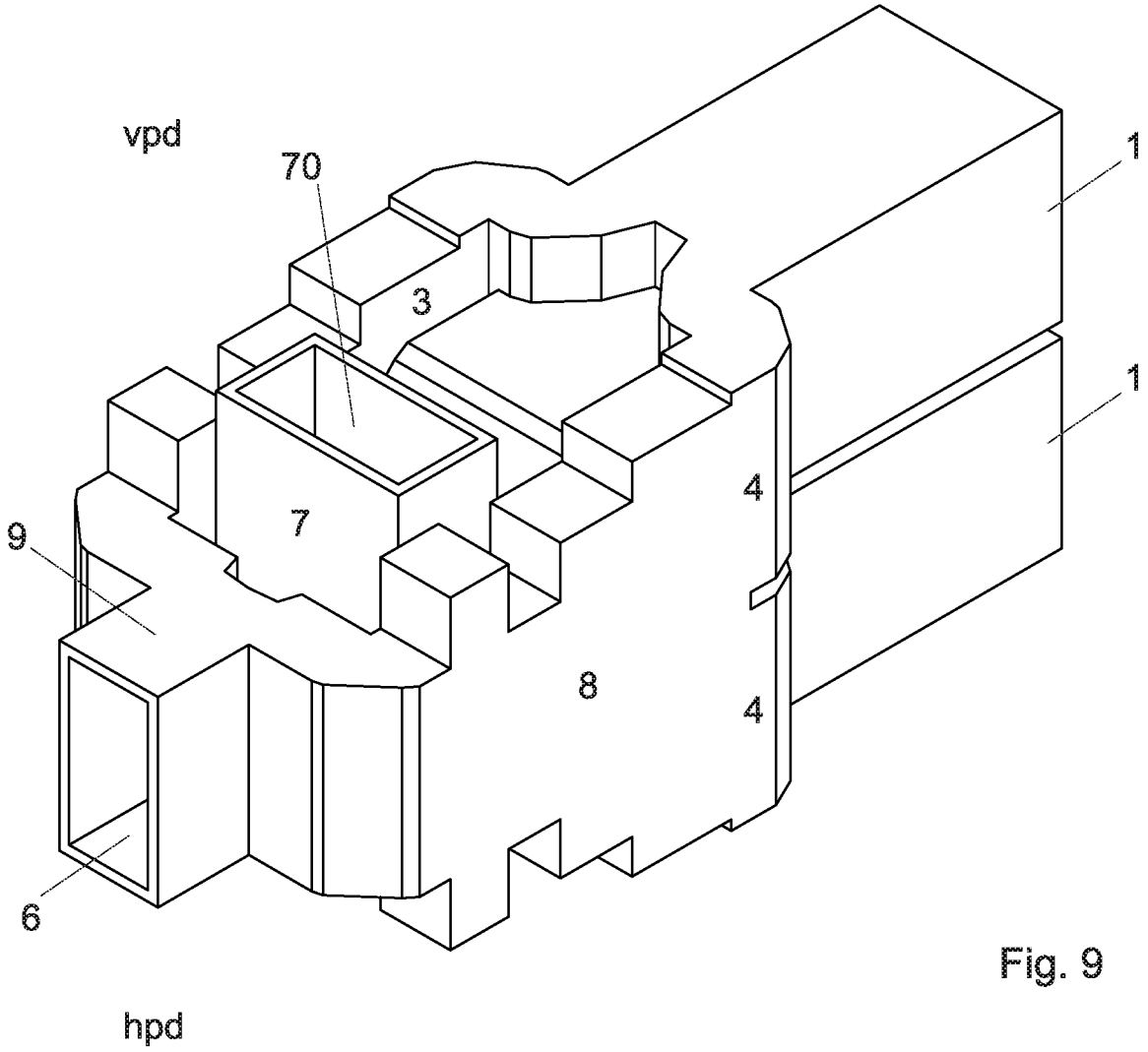
FIG. 9 shows a complete orthomode transducer with beamforming capabilities, including a stack of two Boifot junctions according to FIGS. 1 and 2 coupled through two power dividers according to FIG. 6, the output port of those power dividers being coupled through another power divider, the orthogonal output being bended.

FIG. 9 shows the orthomode transducer with beamforming capabilities of FIG. 8, but in which the fifth port 70 at the output of the fourth power divider 7 that connects the two through ports 2 is bended, in the upward direction. This bend facilitates the access to the fifth port polarization perpendicular to the Boifot junctions. That path could be also bended in the downward direction without affecting the performance. The access to the fifth port 70 could also be achieved by bending or twisting the power dividers 8, or by splitting this port 70 in two branches (not shown).

Figure 10:
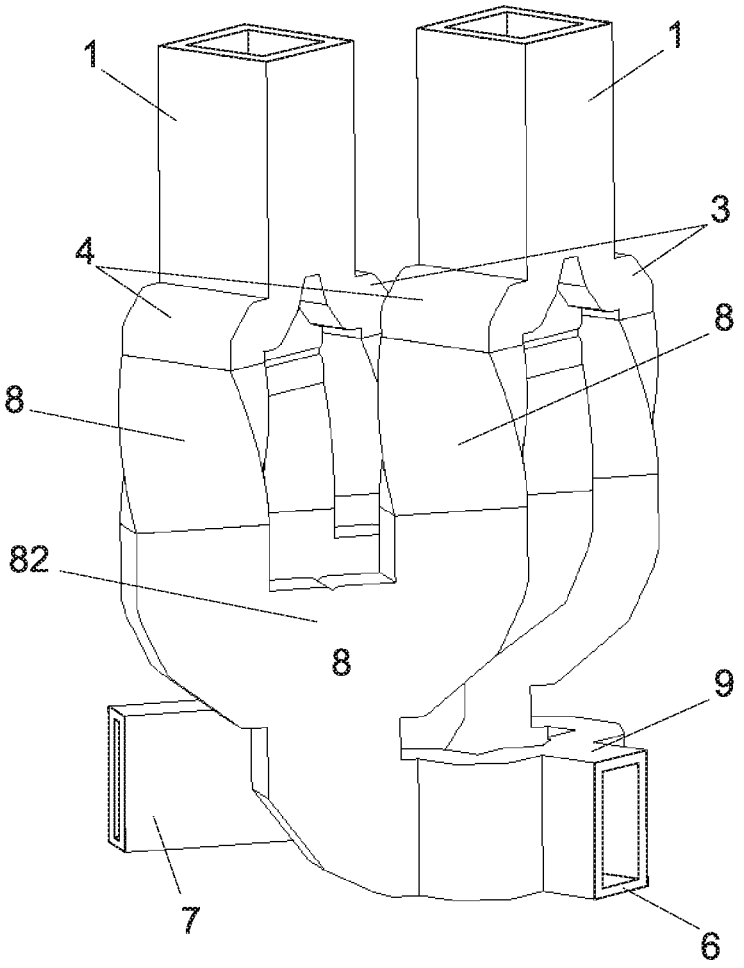
FIG. 10 shows another embodiment of a complete orthomode transducer with beamforming capabilities, including a stack of two Boifot junctions coupled through two power dividers that are twisted, the output port of those power dividers being coupled through another power divider, both outputs being bended.

FIG. 10 shows another embodiment of a complete orthomode transducer with beamforming capabilities, similar to the transducer of FIG. 9, but in which each of the power dividers 8 comprises twisted legs 81 between the lateral ports 3,4 and the dividing portion 82. The twist angle is preferably between 30° and 120°, preferably between 30° and 60°, for example 45°.

In the arrangement of FIG. 10, the input ports 1 of two adjacent Boifot junctions are staggered, thus allowing a further reduction in the distance between the two adjacent junctions in both directions. This arrangement can be used either with a separation between the two Boifot junctions, and between adjacent radiating elements, smaller, equal or larger than one nominal wavelength.

Figure 11:
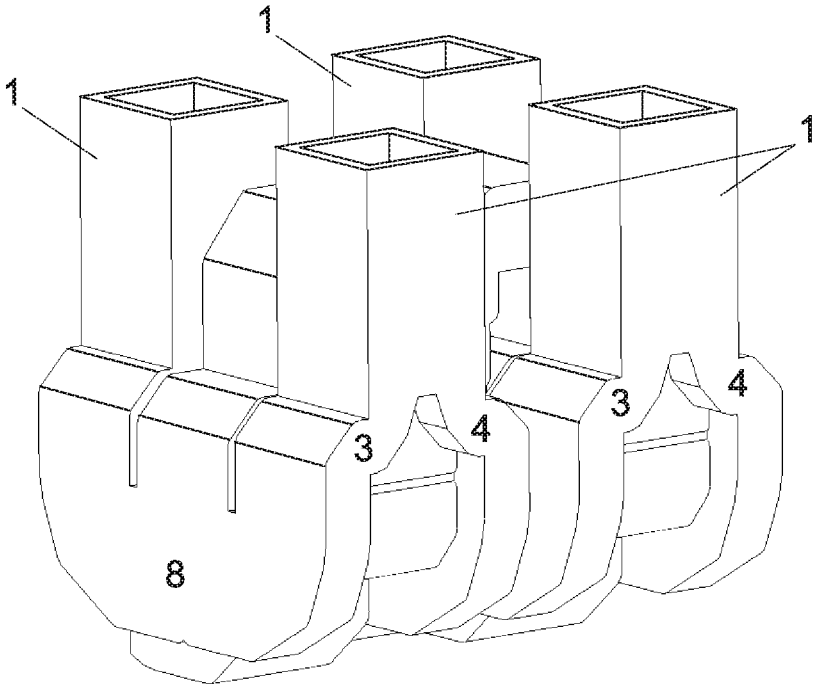
FIGS. 11 and 12 are two different views of an arrangement of two orthomode transducers (each with two Boifot junctions), the orthogonal outputs of each transducer being combined through a power divider.
Figure 12:
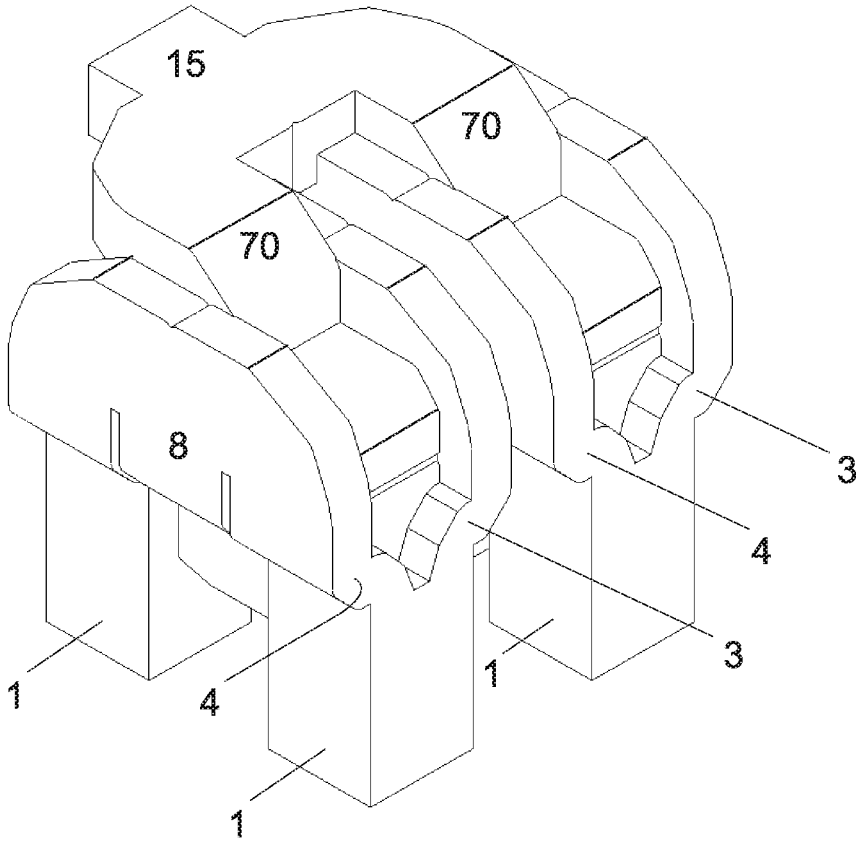
Figure 13:
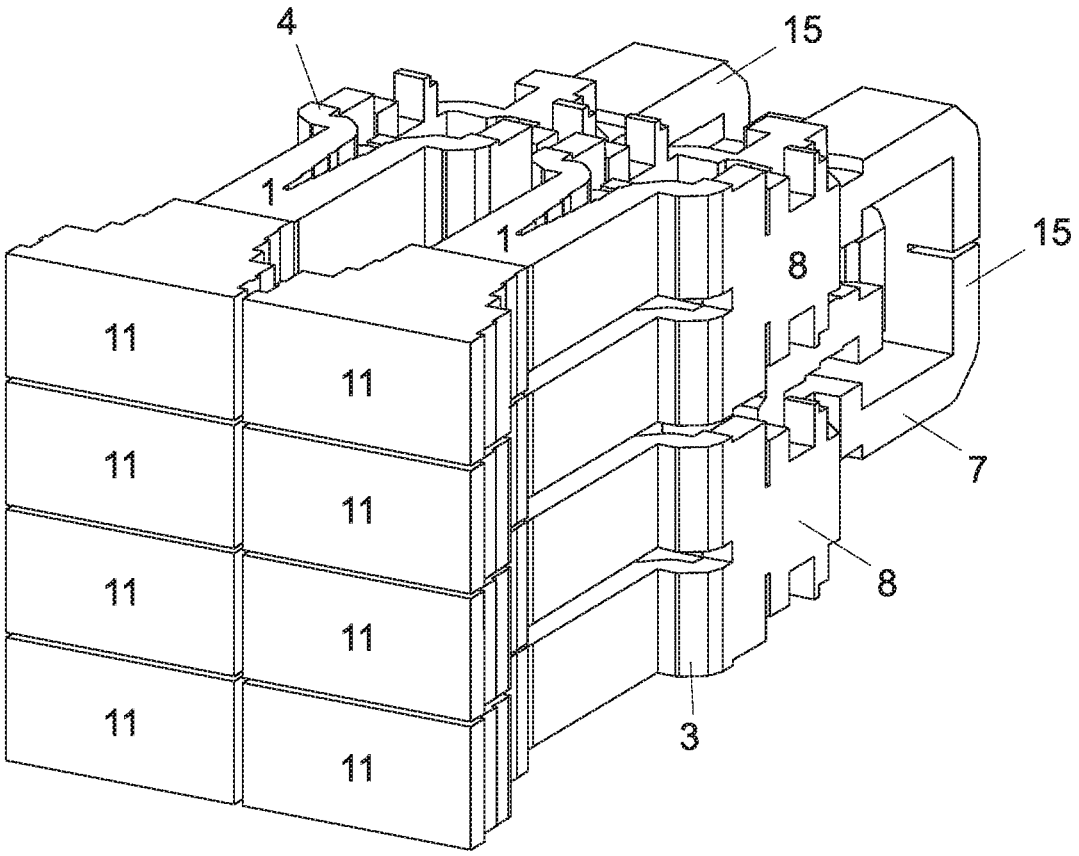
FIG. 13 shows an antenna array using such four orthomode transducer with beamforming capabilities, being connected with each other by means of a series of power dividers, bends and waveguide twists.

A plurality of orthomode transducer with beamforming capabilities as shown on FIG. 8, 9 or 10 could be coupled into one single component. FIGS. 11 and 12 show two different views of an arrangement of two orthomode transducers (each with two Boifot junctions), the bended orthogonal ports 70 at the output of each fourth power divider being combined through an additional power divider 15. As in FIGS. 8 to 10, it is also possible to combine the outputs of the two power dividers 8 of each transducers with a third power divider 9 (not shown), and then to combine the outputs of those two third power dividers 9 with an additional power divider (not shown).

Moreover, as shown on FIG. 11, radiating elements (antennas 11) could be coupled to the input ports 1 of each Boifot junction. In this embodiment, the antenna array comprises 8 antennas 11 coupled through four orthomode transducers with beamforming capabilities as previously described. The horizontally polarized outputs 7 of the stacked orthomode transducer with beamforming capabilities are mutually coupled through an additional waveguide twists, bends and power dividers 13. The vertically horizontally polarized outputs 7 of the stacked orthomode transducer with beamforming capabilities are mutually coupled through an additional waveguide twists, bends and power dividers 14.

The antennas 11 are preferably rectangular horn antennas. In a preferred embodiment, they are stepped horn antennas. Waveguide steps of increasing cross-section are used to improve the reflection coefficient of the orthogonally polarized signals radiated by the antenna. Other antenna profiles such as linear, smooth or spline profiles can be used, being the stepped profile preferred for its shorter axial dimension.

In the case of an array designed for transmission in the Ku-band, the dimensions of the horn antennas are preferably 20 mm×40 mm (around 1λ×2λ at 14.5 GHz).

This antenna could be arranged in an array free of grating lobes for the most relevant angles (<80°).

The separation between two antennas horns in one first direction is preferably smaller than the nominal wavelength and the separation between two antennas horns in one second direction orthogonal to the first direction is smaller than two nominal wavelengths.

The nominal wavelength is the wavelength for or minimal wavelength for which the array is designed and which can be transmitted with minimal attenuation.

Interestingly, this arrangement of FIG. 10 still has a horizontal and a vertical symmetry plane.

Arrays of antennas with different number of antennas and of orthomode power dividers could be used.

The array of antenna could be built as an integral component. Alternatively, it could be assembled from different parts; for example, the antennas 11 could be mounted to the port 1 of the orthomode power dividers.

The antenna array of the invention consists of only antennas, pairs of Boifot junctions forming a new component called orthomode transducer with beamforming capabilities, power dividers and twisted waveguides.

The bandwidth of the component is determined by the waveguide width, which determines the propagation of the fundamental mode and the higher-order modes. In one embodiment, this width is between 15 and 19.05 mm, for example 16.5 mm and the cutoff frequency of the fundamental (TE10) and the first higher-order (TE20) mode is 9.08 GHz and 18.15 GHz, respectively.

Although the proposed orthomode transducer with beamforming capabilities has been described in a Ku-band Satcom array, it could also be used in other applications.

What is claimed is:

1. An orthomode transducer comprising:

a first Boifot junction;

a second Boifot junction;

each of said first and second Boifot junction comprising a dual polarized port, a first lateral port, a second lateral port, the first and second lateral port being single polarized, and a third single polarized port along the propagation direction of a signal in the dual polarized port;

a first power divider for coupling the first lateral port of the first Boifot junction with the first lateral port of the second Boifot junction to a third port of the first power divider;

a second power divider for coupling the second lateral port of the first Boifot junction with the second lateral port of the second Boifot junction to a third port of the second power divider;

a third power divider for coupling the third port of the first power divider with the third port of the second power divider to a fourth single polarization port;

a fourth power divider for coupling the third single polarized port of the first Boifot junction with the third single polarized port of the second Boifot junction to a fifth single polarized port.

2. The orthomode transducer of claim 1, in which the fourth power divider is placed between the first and the second power divider.

3. The orthomode transducer of claim 2, wherein said fourth single polarization port transmits a first linear polarization while said fifth single polarized port transmits a second linear polarization orthogonal to the first polarization.

4. The orthomode transducer of claim 1, comprising two symmetry planes.

5. The orthomode transducer of claim 1, wherein the first and second power dividers are stepped.

6. The orthomode transducer of claim 1, being adapted for one among:

C-band satellite communication;

X-band satellite communication;

Ku-band satellite communication;

Ka-band satellite communication;

Q-band satellite communication; and/or

V-band satellite communication.

7. The orthomode transducer of claim 1, being monobloc, i.e. made out of one single piece.

8. The orthomode transducer of claim 7, comprising a 3D printed core and conductive plated sides.

9. The orthomode transducer of claim 8, comprising a 3D printed conductive core.

10. An antenna array comprising at least one orthomode power divider according to claim 1, and one horn antenna connected to the dual polarized port of each of said Boifot junctions.

11. The antenna array of claim 10, said horn antennas being rectangular horn antennas, preferably stepped rectangular horn antennas.

12. The antenna array of claim 11, said horn antennas having dimensions of 20 mm×40 mm or 10 mm×20 mm.

13. The antenna array of claim 10, said horn antennas being circular horn antennas.

14. The antenna array of claim 10, wherein the separation between said horn antennas in one first direction is smaller than a nominal wavelength and the separation between said horn antennas in one second direction orthogonal to the first direction is smaller than two nominal wavelengths, the nominal wavelength being the wavelength for which the antenna array is designed.

15. The antenna array of claim 10, having two symmetry planes.

* * * * *